US006261190B1

(12) United States Patent
Ashcraft

(10) Patent No.: US 6,261,190 B1
(45) Date of Patent: Jul. 17, 2001

(54) PUTTER WITH ALIGNMENT FIGURE

(76) Inventor: Danny C. Ashcraft, 1180 Miramar Dr., Vista, CA (US) 92009

( * ) Notice: Subject to any disclaimer, the term of this patent is extended or adjusted under 35 U.S.C. 154(b) by 0 days.

(21) Appl. No.: 09/391,929

(22) Filed: Sep. 8, 1999

(51) Int. Cl.[7] ..... A63B 69/36; A63B 53/04
(52) U.S. Cl. ..... 473/251; 473/254
(58) Field of Search ..... 473/324, 340, 473/238, 251, 252, 253, 254, 242, 268; D21/736, 742, 746

(56) References Cited

U.S. PATENT DOCUMENTS

| | | | |
|---|---|---|---|
| 3,880,430 | | 4/1975 | McCabe . |
| 3,931,975 | * | 1/1976 | Cook . |
| 4,043,562 | | 8/1977 | Shillington . |
| 4,128,244 | * | 12/1978 | Duclos . |
| 4,136,877 | | 1/1979 | Antonious . |
| 4,209,172 | * | 6/1980 | Yamamoto . |
| 4,231,576 | * | 11/1980 | Perkins . |
| 4,458,900 | * | 7/1984 | Antonious . |
| 4,508,350 | * | 4/1985 | Duclos . |
| 4,693,478 | * | 9/1987 | Long . |
| 4,741,535 | * | 5/1988 | Leonhardt . |
| 4,913,438 | * | 4/1990 | Anderson . |
| 4,986,544 | * | 1/1991 | Benson . |
| 5,174,573 | | 12/1992 | Desbiolles et al. . |
| 5,429,366 | * | 7/1995 | McCabe . |
| 5,489,097 | * | 2/1996 | Simmons . |
| 5,533,728 | * | 7/1996 | Pehoski . |
| 5,538,249 | | 7/1996 | Benson . |
| 5,830,078 | * | 11/1998 | McMahan . |
| 5,846,140 | * | 12/1998 | Hoburg . |
| 5,921,868 | * | 7/1999 | DeMartino . |
| 6,062,986 | * | 5/2000 | Kaise . |

OTHER PUBLICATIONS

Patent Abstracts Of Japan, App. No. 09350137, App. Date Dec. 5, 1997, Sato, "Golf Putter Head".
Patent Abstracts of Japan, App. No. 0815877, App. Date Jul. 12, 1996, Nagano, "Golf Putter".
Patent Abstracts of Japan, App. No. 08241429, App. Date Aug. 24, 1996, Kobayashi et al, "Golf Putter".
PCT International Search Report for PCT/US99/28295.

* cited by examiner

*Primary Examiner*—Sebastiano Passaniti
(74) *Attorney, Agent, or Firm*—Gray Care Ware Freidenrich

(57) ABSTRACT

A golf club putter has a putter head including a plurality offset surfaces, each of the offset surfaces containing a respective portion of an alignment figure that has a periphery enclosing an area. Each respective portion of the alignment figure includes respective sections of the periphery. Disorientation of the putter head may be detected by transposition of each portion of the alignment figure with respect to the other portions. Correct orientation of the putter head is indicated by precise alignment of the portions to present the alignment figure without apparent distortion.

27 Claims, 6 Drawing Sheets

PUTTER WITH ALIGNMENT FIGURE

BACKGROUND OF THE INVENTION

The invention concerns a golf club putter with a putter head having an alignment figure disposed on two offset surfaces of the putter head which cause the alignment figure to separate in characteristic ways to indicate disorientation of the putter.

The prior art does provide for the placement of a mark on a putter to aid a golfer in aligning the sweet spot of the putter with a golf ball. Such a line may typically be disposed on one or more top surfaces of a putter. However, the alignment of a putter is a complex three-dimensional relationship in which pitch and roll angles of the putter play an important part. In this regard, the problem is to orient one particular surface of the putter—the striking face—with respect to the surface of a golf ball when the putt is lined up and the ball is struck by the putter. The single line marks of the prior art merely indicate proximity of the sweet spot to the ball; they do not provide effective indications to a golfer of three-dimensional orientation of the putter face. Therefore, the problem to be solved is that of providing a visual indication to a golfer of three-dimensional orientation of the striking face of a putter.

SUMMARY OF THE INVENTION

The problem is solved in this invention by provision of an alignment figure on a golf putter head having a periphery that encloses an area and is comprised of two or more portions, each portion including sections of the periphery. Each portion is disposed on a respective surface of the golf putter head in such a manner as to indicate the degree of orientation of the putter by the degree of alignment between the portions of the alignment figure.

An object of this invention is therefore to provide a putter having an alignment figure that permits a golfer to detect and correct three-dimensional disorientation of a putter while lining up the putter to strike the ball.

A second objective of this invention is to provide a putter having two or more separated surfaces on the putter in which a first portion of the alignment figure is disposed on a first of the surfaces and a second portion of the alignment figure is disposed on a second of the surfaces, with each portion in alignment with the other portion.

A third objective of this invention is to provide a putter having such an alignment figure in which the figure is a closed one. Symmetrical or non-symmetrical.

A further objective is to provide such a putter in which the figure is a triangle, a quadrilateral, a polygon, a circle, or an oval.

Other objects and advantages of this invention will manifest themselves when the following detailed description is read with reference to the below-described drawings, in which.

DETAILED DESCRIPTION OF THE PREFERRED EMBODIMENTS

Figure 1:
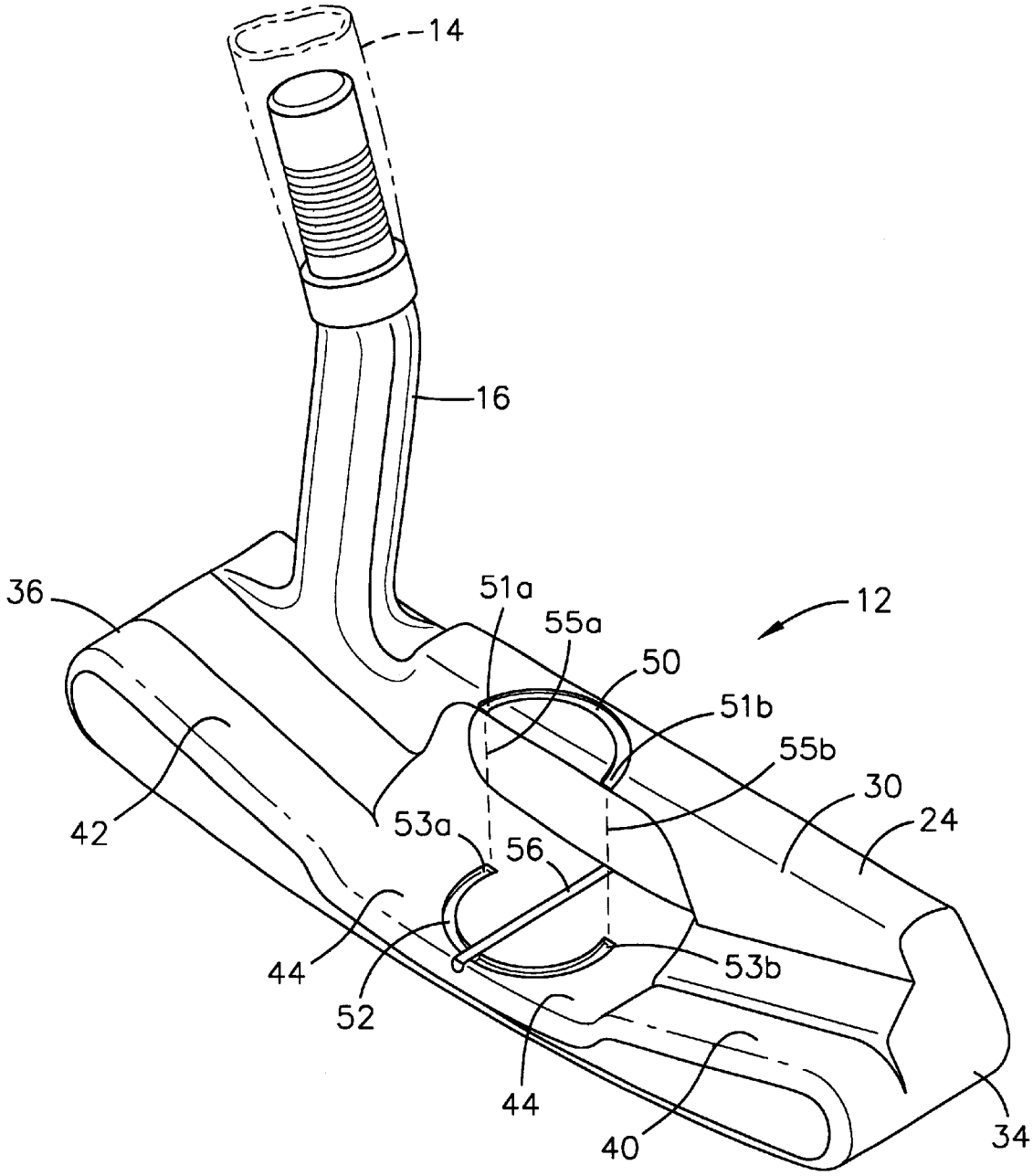
FIG. 1 is a perspective view of a putter according to this invention.

The invention is used with a golf club putter ("putter") that is illustrated, for example, in FIGS. 1 through 4. The putter includes a putter head 12, a shaft 14, and an attachment mechanism 16 that connects the shaft to the putter head 12. The attachment mechanism is exemplified in the figures by a hosel. The invention may be embodied in a completely assembled putter; it may also be embodied in a putter head such as the putter head 12.

The invention is presented in the following description in a preferred embodiment that splits or cleaves an alignment figure into two portions, with each portion disposed on a respective one of two offset surfaces. This is intended to illustrate the invention in a preferred embodiment. In fact, more than two alignment figure portions may be distributed over two or more surfaces without departing from the spirit or scope of the invention.

The putter head 12 includes a wall 20 having a first side 22 and a second side 26. The first and second sides 22 and 26 are planar, vertical and face in opposing directions. The first side 22 includes a striking face which strikes a golf ball when a golfer makes a putt. The wall 20 includes a first surface 24 that is transverse to the first and second sides 22 and 26; the first surface 24 meets the first side 22 at a first edge 28 and meets the second side 26 a second edge 30. The putter head 12 includes a sole 32 disposed underneath the wall 20. The first surface 24 and sole 32 face in opposite directions. From another aspect, the first surface is upwardly oriented with respect to the sole, which faces downwardly. The forward end portion of the putter head 12 forms a toe 34. The back end portion of the putter head 12 forms a heel 36. The wall 20 extends between the heel 36 and the toe 34.

A second surface includes lateral ramped sections 40 and 42 and a concave center section 44. The lateral ramped sections 40 and 42 ramp downwardly toward the center section 44 from the toe 34 and heel 36, respectively. The concave center section 44 is symmetrical with and is oriented to face in the same direction as the first surface 24, but is displaced therefrom in the direction of the sole 32. The second surfaces is also upwardly oriented, with respect to the sole.

Figure 2:
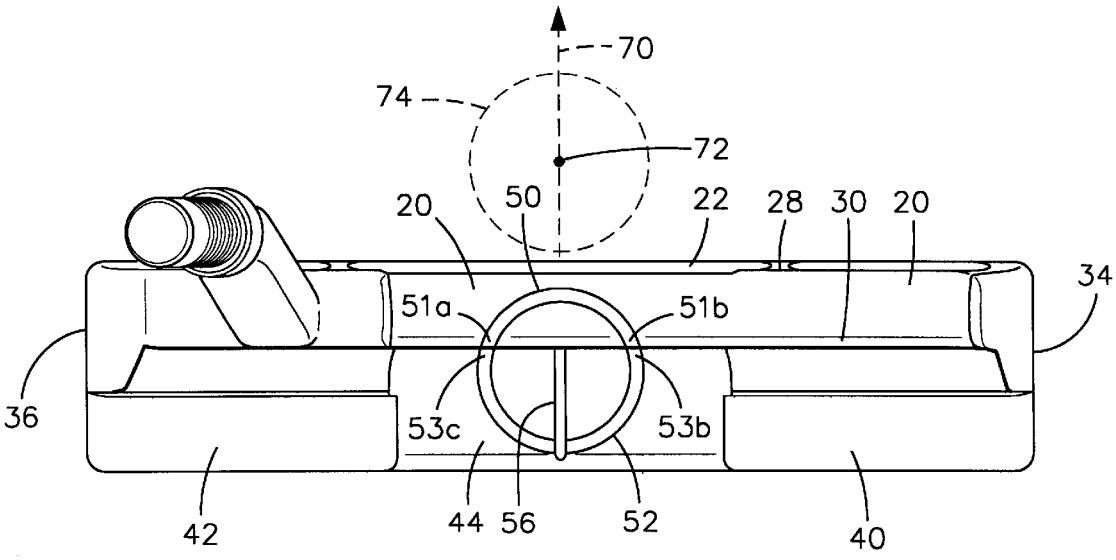
FIG. 2 is a top plan view drawing of the putter of FIG. 1.
Figure 3:
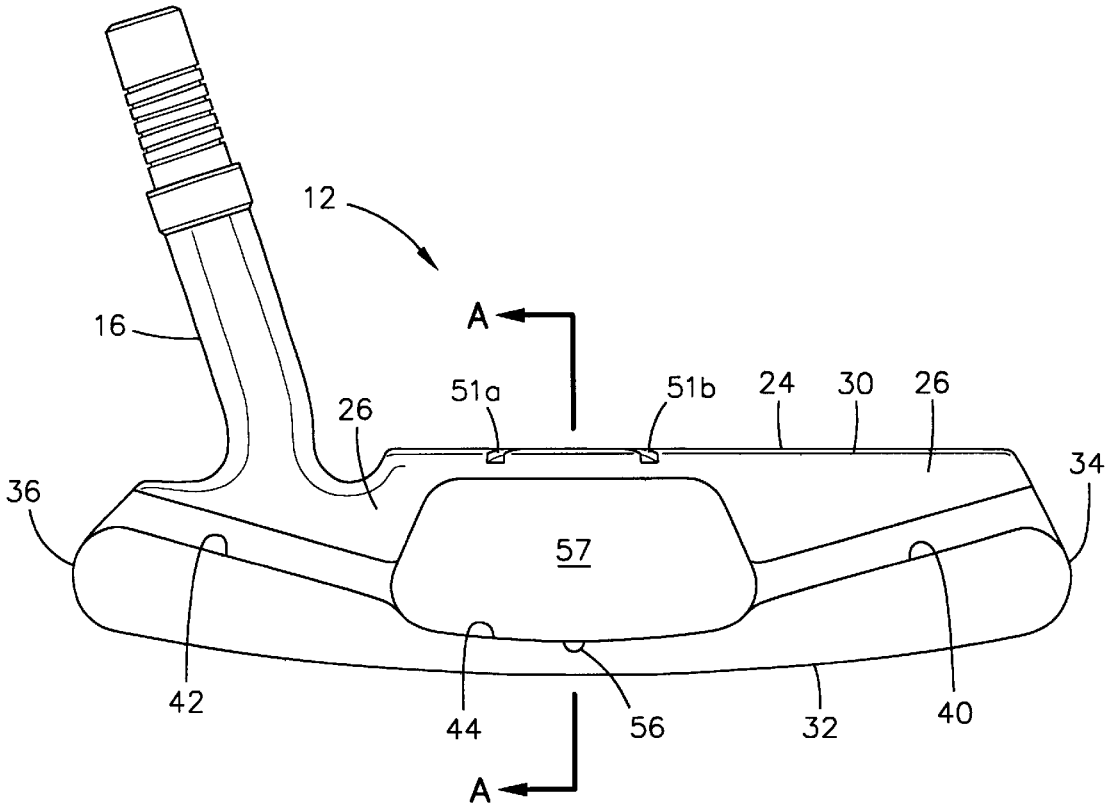
FIG. 3 is a side elevation view drawing of the putter of FIG. 1.
Figure 4:
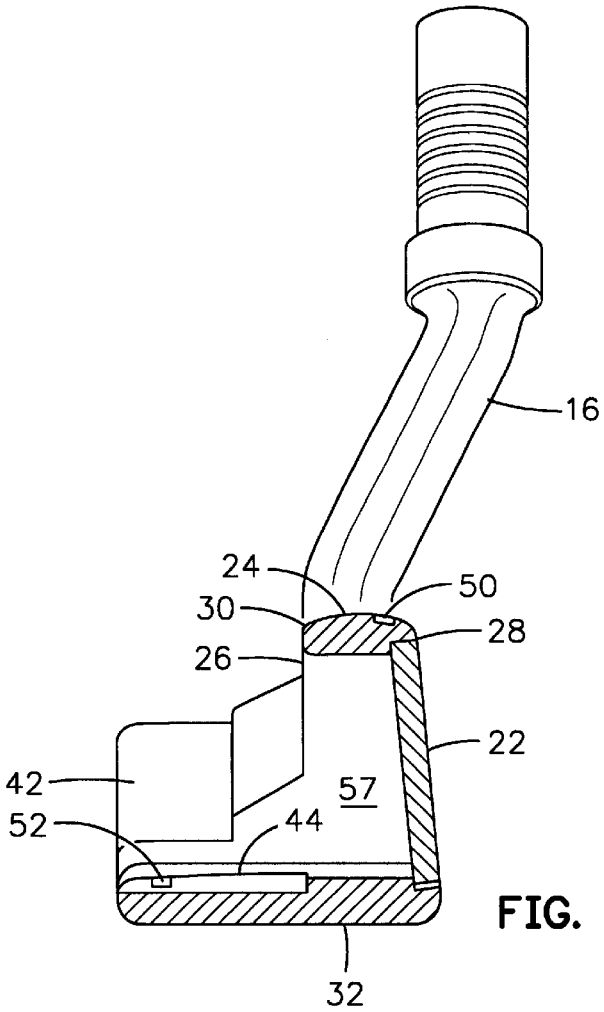
FIG. 4 is a sectional view drawing of the putter of FIG. 3 taken along A—A of FIG. 1.

An alignment figure has first and second portions 50 and 52. The first portion 50 of the alignment figure is disposed on the first surface 24, while the second portion 52 of the alignment figure is disposed on the concave center section 44 of the second surface. The two portions 50 and 52, when the putter head 12 is viewed in the manner illustrated in the top plan view of FIG. 2, form a closed figure having a periphery which traverses a border between the two portions 50 and 52 in at least two locations. As FIG. 2 illustrates, the border is contiguous with the second edge 30. The first portion 50 of the alignment figure is disposed on the first surface 24 such that respective sections 51*a* and 51*b* of the periphery of the alignment figure extend to the edge 30. The second portion 52 of the alignment figure is disposed on the center portion 44 of the second surface such that respective sections 53*a* and 53*b* of the periphery of the alignment figure extend to the vertical projection of the second edge 30 onto the center section 44 of the second surface. In this respect, the ends of the respective sections 51*a* and 51*b* align with corresponding ends of the respective sections 53*a* and 53*b*. Here, "alignment" means that the ends of the respective sections extend to, or almost to, parallel lines 55*a* and 55*b* that are contained in the vertical projection of the edge 30 onto the second surface.

The putter head 12 further includes a recess 57 into the second side 26 of the wall 20, between the first and second alignment figure portions 50 and 52, that permit the concave center section 44 of the surface to extend into the wall 20, underneath the first surface 24. An elongated sweet spot indicating mark 56 may be provided on either, or both of the first and second surfaces to indicate the location of the sweet spot on the striking surface of the putter head 12. In these figures, the mark 56 is placed on the concave center section 44 of the second surface.

The putter head may be molded by casting, or it may be machined; it may be formed from stainless steel, or any other appropriate material such as aluminum, cold rolled steel, brass, or bronze. The alignment FIGURE 50, 52 and the sweet spot mark 56 (if elected) may be formed by conventional means during casting or machining and then highlighted by addition of a color during a paint fill step. Alternatively, the figure portion can be provided on stickers or decals and applied thereby directly to the surfaces.

Figure 5A:
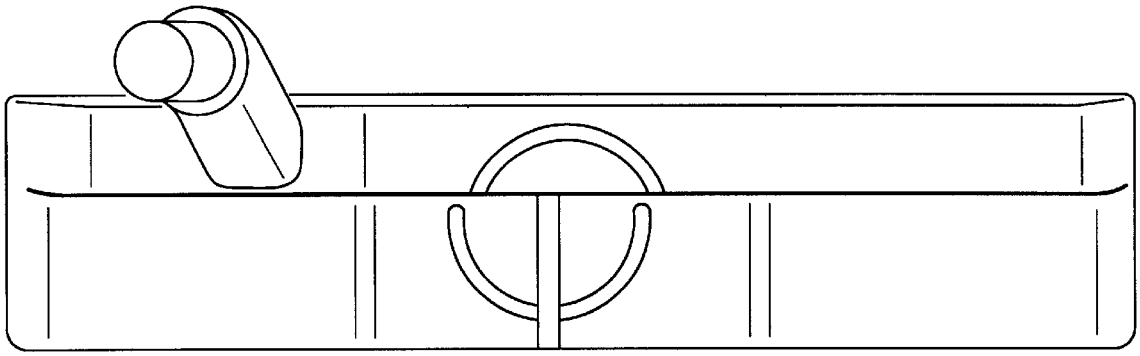
FIGS. 5A, 5B, 5C and 5D illustrate use of the putter of FIG. 1 in orienting the striking face with a golf ball.
Figure 5B:
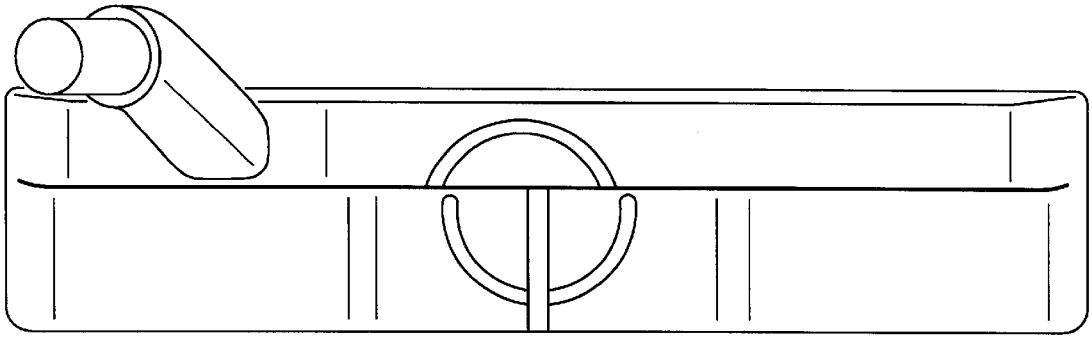
Figure 5C:
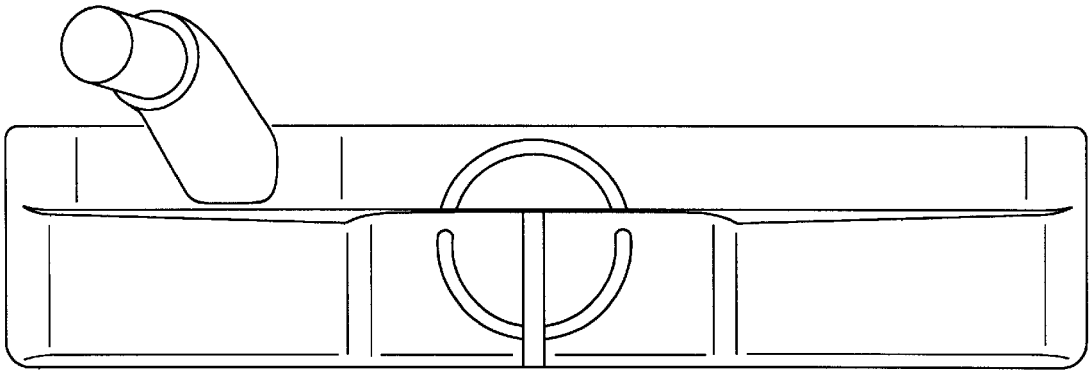
Figure 5D:
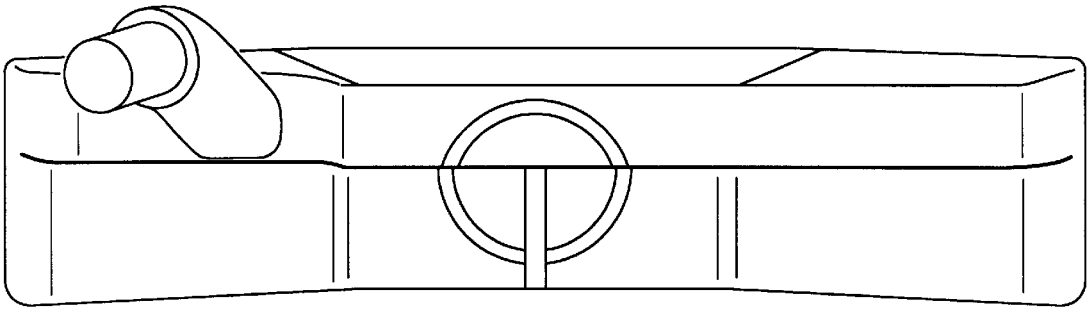

In use, a golfer observes the putter 12 by looking down to observe the first and second surfaces in top plan view. This is shown in FIG. 2. Ideal alignment (FIG. 2) is illustrated by the projection 70 of the center of the striking face of the putter through the center 72 of a golf ball 74. This may be referred to as "ideal orientation". With ideal orientation, the alignment figure (in this case a circle) is closed, with the respective sections 51*a* and 51*b* of the periphery of the alignment figure portion 50 extending to and in alignment with the corresponding respective sections 53*a* and 53*b* of the periphery of the alignment figure portion 52. Disorientation as may occur when the putter head 12 is rotated on the centerline 70 by raising the heel and lowering the toe. The effect with respect to the alignment figure is illustrated in FIG. 5A: the alignment figure portions 50 and 52 are misaligned, with the portion 50 shifted forwardly, toward the toe, and the portion 52 shifted rearwardly, toward the heel. FIG. 5B shows misalignment between the portions 50 and 52 caused by a rotation on the centerline 70 by raising the toe and lowering the heel. FIG. 5C shows separation of the alignment figure portions 50 and 52 by rotation of the putter head 12 about a longitudinal axis with the direction of rotation being toward the top of the figure. FIG. 5D shows a misalignment of the alignment figure portions 50 and 52 by rotation about the longitudinal axis of the putter head 12 in a direction opposite that of FIG. 5C. It should be realized that the misalignments just described may be caused either by movement of the putter head 12, or by movement of a golfer's line of sight with respect to the first and second surfaces of the putter head. Misalignment can also be caused by compounding these error-inducing actions. In any event, misalignment of the putter head can be detected visually by the golfer using the alignment figure and corrected by restoring the ideal orientation of the putter, as indicated by correct alignment of the alignment figure portions 50 and 52 in FIG. 2.

Figure 6A:
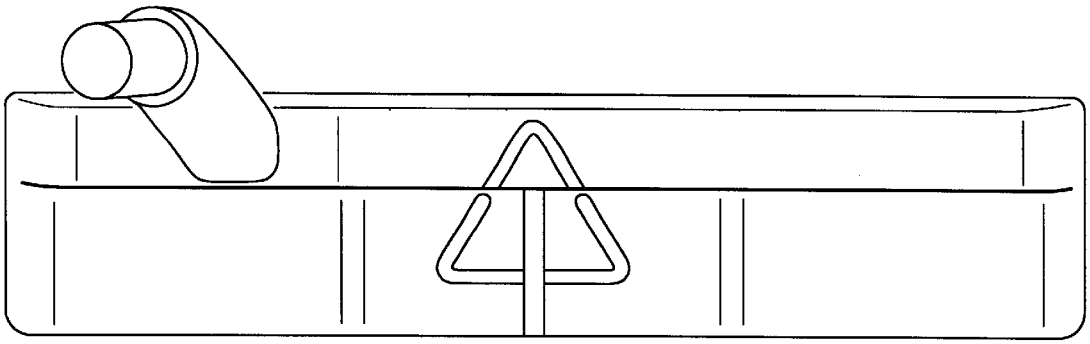
FIGS. 6A–6E illustrate respective embodiments of the alignment figure used in connection with a putter according to the invention.
Figure 6B:
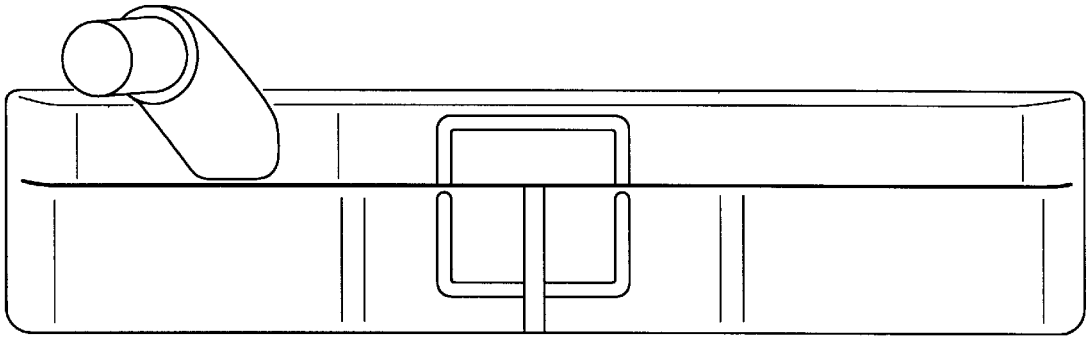
Figure 6C:
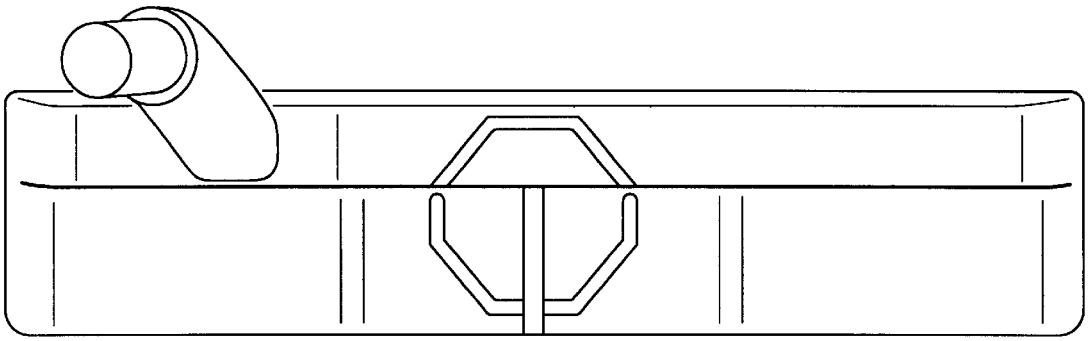
Figure 6D:
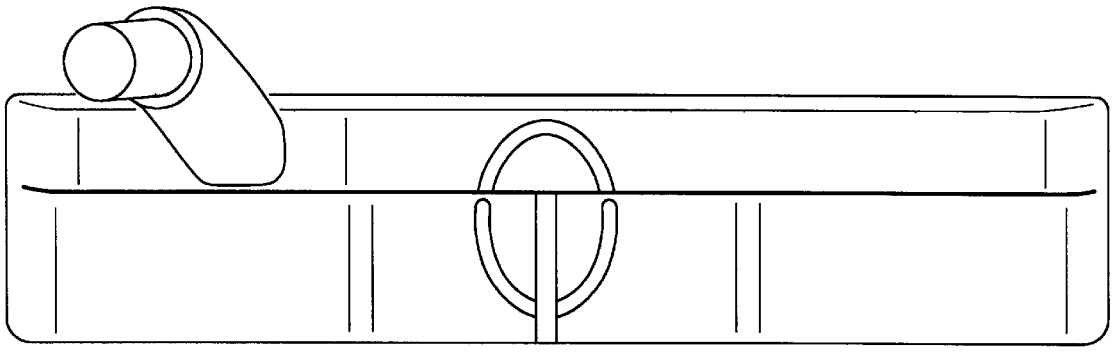
Figure 6E:
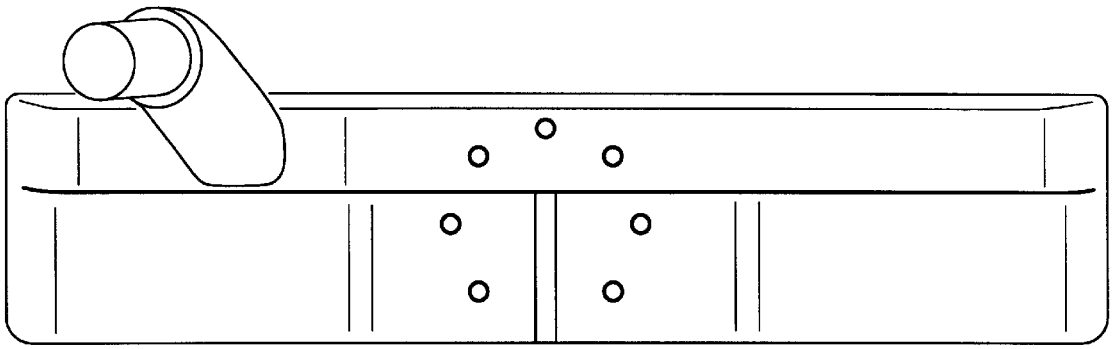

A closed alignment figure may be provided by any number of essential geometrical shapes, including the circle illustrated in FIG. 2, the triangle illustrated in FIG. 6A, the quadrilateral illustrated in FIG. 6B, the polygon illustrated in FIG. 6C, and the oval illustrated in FIG. 6D. All of these figures illustrate an alignment figure with a continuous periphery that outlines an area. This is not to say that the area of the figure within the periphery may not be partially or entirely filled in. Further, the periphery may be discontinuous, particularly if election is made to include the sweet spot mark 56 on either or both of the first and second surfaces of the putter head. A discontinuous periphery may also define the alignment figure, as illustrated in the circular figure formed by the circular array of dots in FIG. 5E. Lastly, the alignment figures shown and described are symmetrical; this is not intended to exclude nonsymmetrical or asymmetrical figures, which are included in the scope of the invention.

Clearly, other embodiments and modifications of this invention will occur readily to those of ordinary skill in the art in view of these teachings. Therefore, this invention is to be limited only by following claims, which include all such embodiments and modifications when viewed in conjunction with the above specification and accompanying drawings.

I claim:

1. A putter, comprising:

a shaft; and a putter head connected to the shaft and including a sole, a heel, a toe, and a wall between the heel and toe, the wall having opposing sides, a first side of the opposing sides being a striking face;

a first surface, disposed above the sole on the wall, that meets the first side along a first edge and meets the second side along a second edge;

at least a second surface offset from the first surface toward the sole, the second surface meeting the second side; and an alignment figure having a periphery and at least two portions, each portion including sections of the periphery;

a first portion of the alignment figure being disposed on the first surface with each section of the periphery extending to the second edge; and at least a second portion of the alignment figure being disposed on the second surface with each section of the periphery extending toward the second edge, in alignment with a corresponding section included in the first portion.

2. The putter of claim 1, further including an elongated mark on the second surface, the mark aligned with a spot on the striking face.

3. The putter of claim 1, further including a recess in the second side of the wall between the first alignment figure portion and the second alignment figure portion.

4. The putter of claim 3, wherein a portion of the second surface extends into the recess.

5. The putter of claim 1, wherein the first surface is transverse to the second side.

6. The putter of claim 1, wherein the second surface has a concave shape with a center section and two lateral sections that ramp upwardly from the center section toward the toe and heel of the putter head, the second portion of the alignment figure being disposed on the center section of the second surface.

7. The putter of claim 1, wherein the alignment figure is a closed figure.

8. The putter of claim 7, wherein the closed figure is selected from the group including a triangle, a quadrilateral, a polygon, a circle, and an oval.

9. The putter of claim 7, wherein the closed figure is outlined by the periphery.

10. The putter of claim 7, wherein the periphery is discontinuous.

11. An apparatus for a golf putter, comprising:

a putter head including a sole, a heel, a toe, and a wall between the heel and toe, the wall having opposing sides, a first side of the opposing sides being a striking face;

a first surface, disposed above the sole on the wall, that meets the first side along a first edge and meets the second side along a second edge;

at least a second surface offset from the first surface toward the sole, the second surface meeting the second side; and an alignment figure having a periphery and at least two portions, each portion including sections of the periphery;

a first portion of the alignment figure being disposed on the first surface with each section of the periphery extending to the second edge; and a second portion of the alignment figure being disposed on the second surface with each section of the periphery extending toward the second edge, in alignment with a corresponding section included in the first portion.

12. The apparatus of claim 11, further including an elongated mark on the second surface, the mark aligned with a spot on the striking face.

13. The apparatus of claim 11, further including a recess in the second side of the wall between the first alignment figure portion and the second alignment figure portion.

14. The apparatus of claim 13, wherein a portion of the second surface extends into the recess.

15. The apparatus of claim 11, wherein the first surface is transverse to the second side.

16. The apparatus of claim 11, wherein the second surface has a concave shape with a center section and two lateral sections that ramp upwardly from the center section toward the toe and heel of the putter head, the second portion of the alignment figure being disposed on the center section of the second surface.

17. The apparatus of claim 11, wherein the alignment figure is a closed figure.

18. The apparatus of claim 17, wherein the closed figure is selected from the group including a triangle, a quadrilateral, a polygon, a circle, and an oval.

19. The apparatus of claim 17, wherein the closed figure is a outlined by the periphery.

20. The apparatus of claim 17, wherein the periphery is discontinuous.

21. An apparatus for a golf putter, comprising:

a putter head including a sole and two opposing sides, a first side of the opposing sides being a striking face;

a plurality of upwardly oriented, separated surfaces aligned vertically on the putter head above the sole;

a first of the plurality of surfaces disposed between the opposing sides;

one or more additional surfaces of the plurality of surfaces disposed beside the second side of the opposing sides; and an alignment figure having a periphery defining an area, the alignment figure including a plurality of portions, each portion disposed on a respective surface of the plurality of surfaces, in alignment with another respective portion on another respective surface.

22. The apparatus of claim 21, wherein the periphery defines a closed figure.

23. The apparatus of claim 22, wherein the closed figure is selected from the group including a triangle, a quadrilateral, a polygon, a circle, and an oval.

24. The apparatus of claim 22, wherein the closed figure is outlined by the periphery.

25. The apparatus of claim 22, wherein the alignment figure is a symmetrical figure.

26. The apparatus of claim 21, wherein the plurality of surfaces are two surfaces.

27. The apparatus of claim 26, wherein the plurality of portions are two portions.

* * * * *